US007091945B2

(12) United States Patent
Yamazaki

(10) Patent No.: US 7,091,945 B2
(45) Date of Patent: Aug. 15, 2006

(54) DRIVE CIRCUIT FOR ELECTRO-OPTICAL DEVICE, METHOD OF DRIVING ELECTRO-OPTICAL DEVICE, ELECTRO-OPTICAL APPARATUS, AND ELECTRONIC APPLIANCE

(75) Inventor: Katsunori Yamazaki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 533 days.

(21) Appl. No.: 10/403,023

(22) Filed: Apr. 1, 2003

(65) Prior Publication Data

US 2003/0210239 A1 Nov. 13, 2003

(30) Foreign Application Priority Data

Apr. 3, 2002 (JP) ..... 2002-101177
Sep. 18, 2002 (JP) ..... 2002-271480

(51) Int. Cl.
*G09G 3/36* (2006.01)

(52) U.S. Cl. ..... 345/100; 345/58; 345/94; 345/211

(58) Field of Classification Search ..... 345/58, 345/63, 93, 94, 100, 204, 211, 691
See application file for complete search history.

(56) References Cited

U.S. PATENT DOCUMENTS 5,434,599 A * 7/1995 Hirai et al. ..... 345/100
5,841,410 A * 11/1998 Oda et al. ..... 345/94
6,340,964 B1 * 1/2002 Nakazawa et al. ..... 345/100

FOREIGN PATENT DOCUMENTS

JP A-59-57273 4/1984
JP A-63-240528 10/1988
JP A-64-298899 1/1989
JP A-2-171718 7/1990
JP A-3-253817 11/1991
JP A-3-257426 11/1991
JP A-4-25818 1/1992
JP A-5-181435 7/1993
JP A-6-18848 1/1994
JP A-6-27899 2/1994
JP A-6-180564 6/1994
JP A-7-181445 7/1995
JP A-8-76093 3/1996
JP A-8-94998 4/1996
JP A-8-110765 4/1996

(Continued)

OTHER PUBLICATIONS

Castleberry, Donald E., "Varistor-Controlled Liquid-Crystal Displays", *IEEE Transactions on Electron Devices*, vol. ED-26, No. 8, Aug. 1979, pp. 1123-1128.
Togashi, Seigo et al., "Matrix Liquid Crystal Display Controlled by Nonlinear Devices", *Technical Report of Institute of Television*, ED 782, IPD 86-3, 1984, pp. 13-18.

(Continued)

*Primary Examiner*—Amr A. Awad
(74) *Attorney, Agent, or Firm*—Oliff & Berridge, PLC

(57) ABSTRACT

The invention corrects crosstalk induced between scanning electrodes and signal electrodes in a TFD liquid crystal display. The liquid crystal display is provided with a dummy scanning electrode that intersects with signal electrodes, and is arranged in the same manner as scanning electrodes. Since the dummy scanning electrode is connected to the inverting input terminal of an operational amplifier, the voltage of the dummy scanning electrode is maintained at a reference voltage. When the crosstalk from the signal electrodes occurs, a current flows through a resistor so as to maintain the voltage at the dummy scanning electrode at the reference voltage. The voltage applied to the scanning electrodes is increased or decreased in accordance with the current in order to correct the crosstalk.

4 Claims, 11 Drawing Sheets

FOREIGN PATENT DOCUMENTS

| | | |
|---|---|---|
| JP | A-9-211420 | 8/1997 |
| JP | A-10-39840 | 2/1998 |
| JP | A-10-153759 | 6/1998 |
| JP | A-10-282469 | 10/1998 |
| JP | A-11-45075 | 2/1999 |
| JP | A-11-153779 | 6/1999 |
| JP | A-2000-89198 | 3/2000 |
| JP | A-2000-111947 | 4/2000 |

OTHER PUBLICATIONS

Baraff, David R. et al., "The Optimization of Metal-Insulator-Metal Nonlinear Devices for Use in Multiplexed Liquid Crystal Displays", *IEEE Transactions on Electron Devices*, vol. ED-28, No. 6, Jun. 1981, pp. 736-739.

Niwa, Kenji et al., "LCTV Addressed by MIM Devices", *SID 84 Digest*, 1984, pp. 304-307.

* cited by examiner (a) IDEAL IMAGE (b) IMAGE WITH INDUCED CROSSTALK (a) FIRST EMBODIMENT (b) SECOND EMBODIMENT

DRIVE CIRCUIT FOR ELECTRO-OPTICAL DEVICE, METHOD OF DRIVING ELECTRO-OPTICAL DEVICE, ELECTRO-OPTICAL APPARATUS, AND ELECTRONIC APPLIANCE

BACKGROUND OF THE INVENTION

1. Field of Invention

The present invention relates to a drive circuit for an electro-optical device, a method of driving an electro-optical device, an electro-optical apparatus, and an electronic appliance, all of which are preferably used to display a variety of information.

2. Description of Related Art

In an active matrix liquid crystal display with two-terminal devices or a TFD (thin film diode) active matrix liquid crystal display, a first substrate having a plurality of scanning electrodes is opposed to a second substrate having a plurality of signal electrodes. A liquid crystal layer is sandwiched between the two substrates. A device having a nonlinear current-voltage characteristic is interposed between the liquid crystal layer and each of the scanning electrodes or between the liquid crystal layer and each of the signal electrodes (for example, Japanese Unexamined Patent Application Publication No. H10-039840). Nonlinear two-terminal devices include a device using a ceramic varistor (D. E. Casfleberry, IEEE, ED-26, p. 1123-1128, 1979), a device using an amorphous silicon P-N junction diode (Togashi et al., Technical Report of Institute of Television, ED 782, IPD 86–3, 1984 and Japanese Unexamined Patent Application Publication No. 559-57273), and a device using an MIM (Metal Insulator Metal) element (D. R., Baraff et al, IEEE, ED-28, p. 736–739, 1981 and K. Niwa et al., SID 84, Digest, p. 304–307, 1984).

In some TFD liquid crystal displays, a differential waveform of a signal electrode voltage is superimposed on a scanning electrode voltage via a capacitance between a scanning electrode and a signal electrode. In other words, crosstalk occurring between the scanning electrode and the signal electrode disadvantageously damages the gradation characteristic on a display.

SUMMARY OF THE INVENTION

Accordingly, the present invention provides a drive circuit for an electro-optical device, a method of driving an electro-optical device, an electro-optical apparatus, and an electronic appliance, all of which eliminate the adverse effect of the crosstalk to display high-quality images.

To this end, the present invention provides, in its first aspect, a drive circuit to drive an electro-optical device that includes a plurality of signal electrodes and a plurality of scanning electrodes intersecting with the signal electrodes. The drive circuit includes a scanning-signal determining circuit to determine signal levels at other scanning electrodes based on a signal level at one unselected scanning electrode among the plurality of scanning electrodes.

In the drive circuit for the electro-optical device, the scanning-signal determining circuit may include a circuit segment that suppresses a variation in signal voltage at one unselected scanning electrode among the plurality of scanning electrodes and may determine the signal levels at other scanning electrodes based on a signal level output from the circuit segment.

In the drive circuit for the electro-optical device, no scanning period may be allocated to the unselected scanning electrode and scanning periods may be sequentially allocated to the other scanning electrodes during one frame period.

In the drive circuit for the electro-optical device, the scanning-signal determining circuit preferably includes a resistor connected to the unselected scanning electrode; a voltage source to supply a current to the unselected scanning electrode via the resistor so that the unselected scanning electrode has a predetermined voltage; and a superimposition circuit, superimposing voltage level, correspond to the current supplied to the scanning electrode, to the voltage applied to other scanning electrodes.

In the drive circuit for the electro-optical device, the scanning-signal determining circuit may perform weighting in accordance with the timings at which signals supplied to the plurality of signal electrodes change their polarity during a scanning period of one selected scanning electrode among the plurality of scanning electrodes to determine a signal level at the selected scanning electrode.

In the drive circuit for the electro-optical device, the scanning-signal determining circuit preferably includes a counter circuit to count the timings at which the signals supplied to the plurality of signal electrodes change their polarity for every scanning period of one selected scanning electrode among the plurality of scanning electrodes; and a weighting circuit to perform weighting in accordance with a counter value from the counter circuit to determine a signal level at the selected scanning electrode.

The present invention provides, in its second aspect, a method of driving an electro-optical device that includes a plurality of signal electrodes and a plurality of scanning electrodes intersecting with the signal electrodes. In this method, signal levels at other scanning electrodes are determined based on a signal level at one unselected scanning electrode among the plurality of scanning electrodes.

An electro-optical apparatus of the present invention includes one of the drive circuits for the electro-optical device described above.

An electronic appliance of the present invention includes one of the drive circuits for the electro-optical device described above.

DETAILED DESCRIPTION OF PREFERRED EMBODIMENTS

The structure of a liquid crystal display according to a first exemplary embodiment of the present invention is described below with reference to FIG. 1. The rows labeled 12, 12, and so on denote (n) scanning electrodes (n≧2) that extend to the row direction. Since these scanning electrodes have different y axis values on a display, the scanning electrodes are represented as "Y1, Y2, . . . , Yn" from top. A dummy scanning electrode 50 is provided next to the lowest scanning electrode "Yn." The lines labeled 14, 14, and so on denote (m) signal electrodes (m≧2) that extend to the line direction. Since these signal electrodes have different x axis values on the display, the signal electrodes are represented as "X1, X2, . . . , Xm" from left.

Figure 9:
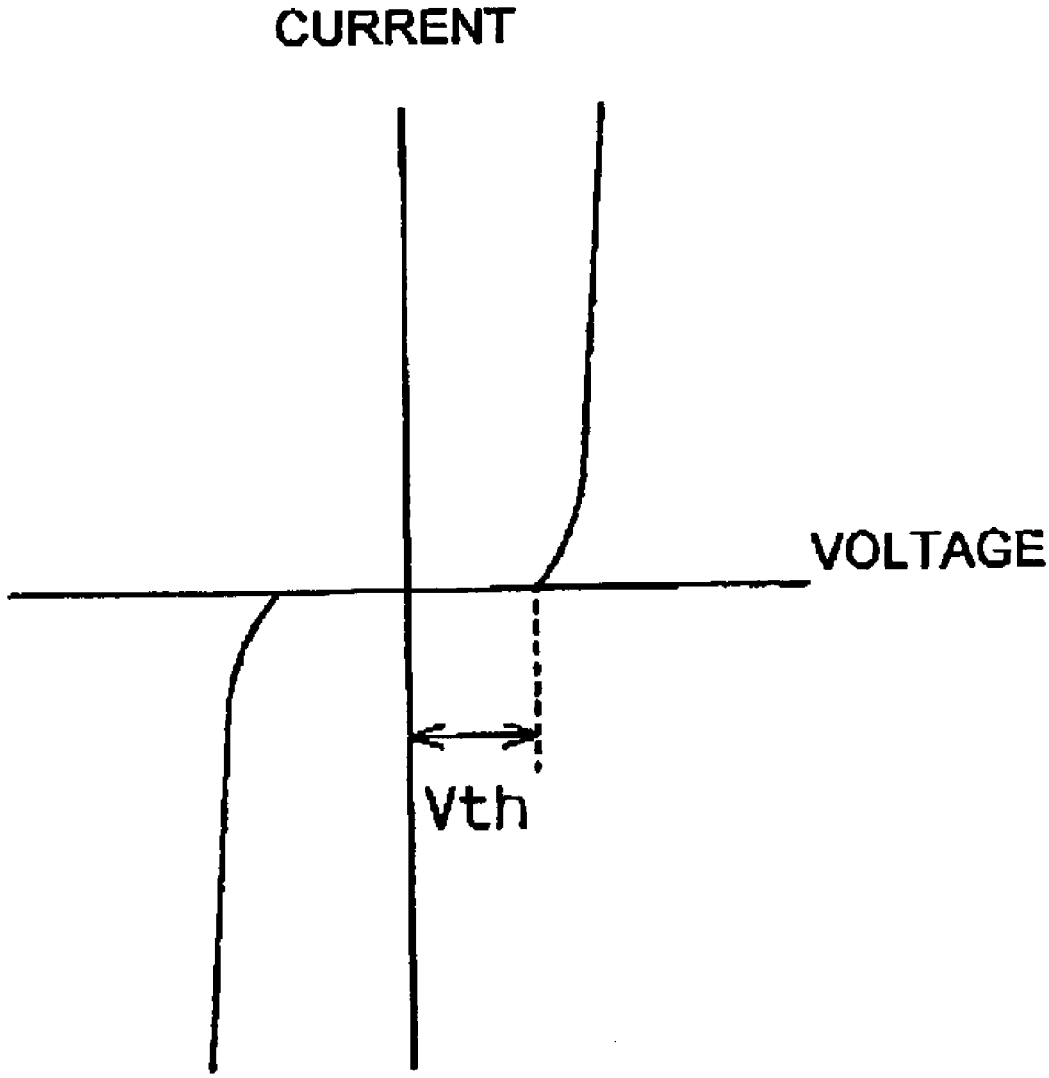
FIG. 9 is a graph showing a characteristic of a nonlinear two-terminal device 20.

A nonlinear two-terminal device 20 and a liquid crystal layer 18 are connected in series at each intersection point of the scanning electrodes and the signal electrodes to form a pixel. The coordinate of a pixel is represented by a combination of the coordinates of signal electrodes and those of scanning electrodes that intersects each other, such as (X1, Y1). The components described above constitute a liquid crystal display 101. The nonlinear two-terminal device 20 has a current-voltage characteristic as shown in FIG. 9. Referring to FIG. 9, negligible current flows around at zero voltage. However, when the absolute voltage exceeds a threshold voltage "Vth," the current sharply increases with the increase in voltage.

A data-signal drive circuit 90 applies signal electrode voltages "VX1, VX2, . . . , VXm" to the respective signal electrodes. Each signal electrode voltage is either "+VSIG" or "−VSIG," as described below, and the signal electrode voltage is switched between the two values at timings in accordance with the gradation of pixels.

The inverting input of an operational amplifier 32 is connected to one end of the dummy scanning electrode 50 and a reference voltage "VGND" is applied to the non-inverting input terminal of the operational amplifier 32. A resistor 34 is connected between the inverting input terminal and the output terminal of the operational amplifier 32. Since the two input terminals of the operational amplifier 32 are imaginary short-circuited with each other, the voltage is changed at the output terminal of the operational amplifier 32 such that the voltage of the one end of the dummy scanning electrode 50 is maintained at the reference voltage "VGND."

A "voltage+VSEL" is applied to one end of a resistor 40, and the other end of the resistor 40 is connected to the resistor 34 via a capacitor 36. The non-inverting input terminal of an operational amplifier 44 is connected to the other end of the resistor 40 and the inverting input terminal of the operational amplifier 44 is connected to the output terminal of the operational amplifier 44. Hence, the operational amplifier 44 constitutes a voltage follower circuit to output the "voltage+VSEL'" at the other end of the resistor 40 therethrough.

The voltage follower circuit of the operational amplifier 44 is not an essential component. The other end of the resistor 40 may be used as an output terminal.

Accordingly, when a current "Ix" flows through the dummy scanning electrode 50 and resistor 34 due to crosstalk from the signal electrode 14, the resistor 40 is subjected to a voltage drop and the "voltages±VSEL'" are increased or decreased in accordance with the amount of the voltage drop at the resistor 40, that is, in accordance with the voltage change at the output terminal of the operational amplifier 32. A capacitor 38, a resistor 42, and an operational amplifier 46 are connected in the same manner as the capacitor 36, the resistor 40, and the operational amplifier 44, and a "voltage−VSEL'", which is increased or decreased in response to the change in output voltage of the operational amplifier 32, is output in response to the "predetermined voltage−VSEL".

The "voltages±VSEL'" are referred to as "selection voltages", since they are applied to the scanning electrodes that are selected. "Voltages±VHLD'" are referred to as "hold voltages", since they are applied to the scanning electrodes that are not selected. The scanning-signal drive circuit 80 applies scanning electrode voltages "VY1, VY2, . . . , Vyn" to the respective scanning electrodes. Each scanning electrode voltage has a value of either "±VSEL'" or "±VHLD'."

The operation of the first exemplary embodiment in a case where no crosstalk occurs between the signal electrodes and the scanning electrodes is described below. In such a case, since the current "Ix" is "0 (zero)", the selection voltage and "±VSEL'" are equal to the reference voltage VGND and ±VSEL, respectively.

Figure 2:
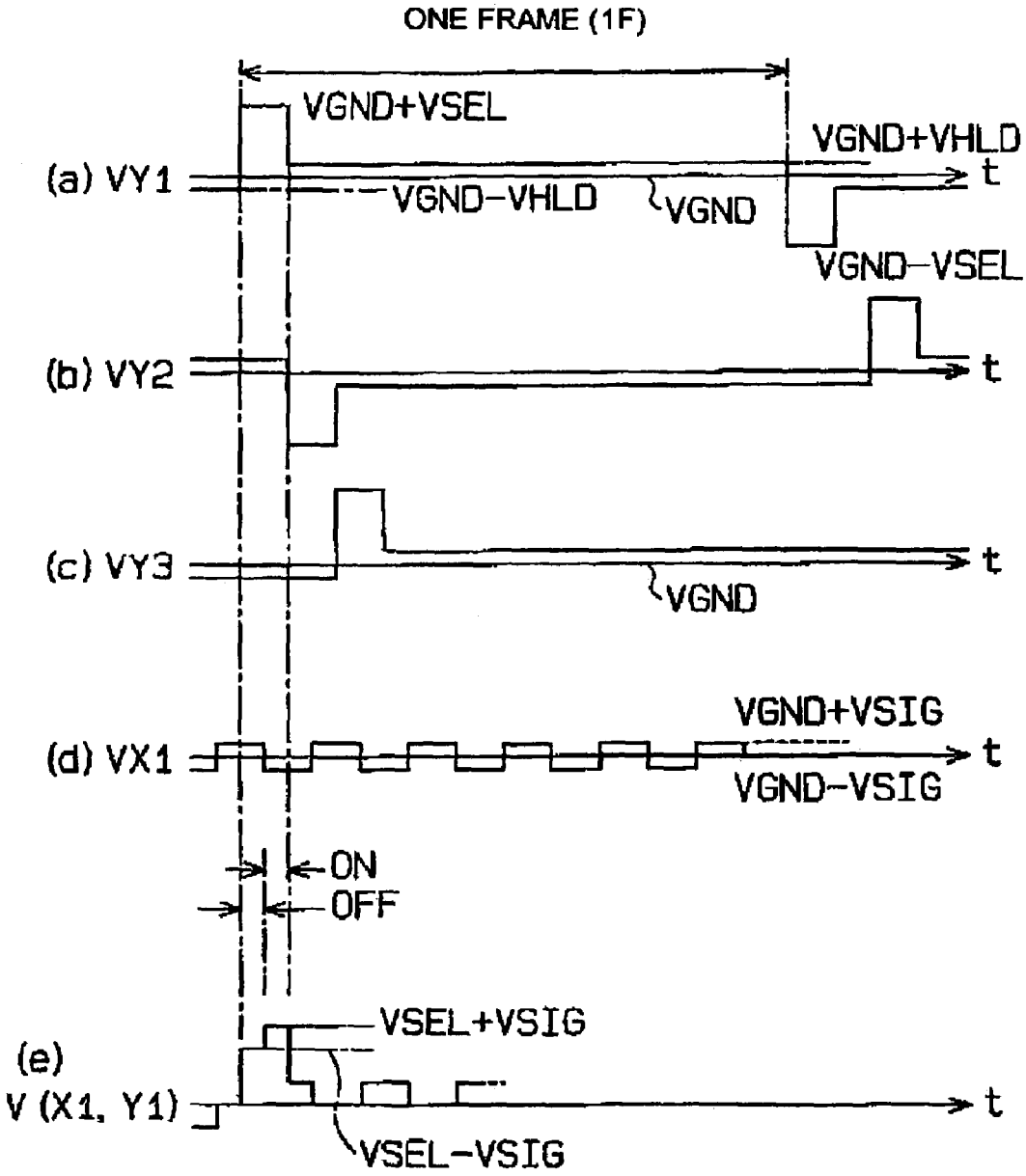
FIGS. 2(*a*)–2(*e*) are waveforms of components showing the basic operation of the electro-optical device in FIG. 1.

The voltages applied to the scanning electrodes 12 (the scanning electrodes "Y1 to Y3") are shown in FIGS. 2(*a*) to 2(*c*). These scanning electrodes 12 are sequentially selected at every line selection period T and either of the selection voltages "±VSEL'(=±VSEL)" is applied to the selected scanning electrode. After the selection of the scanning electrode, either of the hold voltages "±VHLD'(=±VHLD)" is applied to the scanning electrode. The hold voltage is set to "+VHLD" for the selected voltage "+VSEL" while the hold voltage is set to "−VHLD" for the selected voltage "−VSEL".

A period until a cycle of selecting all scanning electrodes is completed is referred to as a frame period. During one frame period, the selection voltage having reverse polarity with respect to the previous frame period is applied to the scanning electrodes that are sequentially selected. For a reason of, for example, preventing flicker, the selection voltage of odd-numbered scanning electrodes has reverse polarity with respect to the selection voltage of even-numbered scanning electrodes.

Either a signal voltage "+VSIG" or a signal voltage "−VSIG" is applied to the signal electrodes 14. FIG. 2(*d*) shows an example of the signal electrode voltage "VX1" applied to the signal electrode "X1". The voltage applied to each pixel is given by the subtraction of the voltage of each of the signal electrodes from the voltage of the corresponding scanning electrode. FIG. 2(*e*) shows one example of the voltage V (X1, Y1) applied to a pixel (X1, Y1).

Referring to FIGS. 2(*a*), 2(*d*), and 2(*e*), the selection period of the scanning electrode "Y1" is divided into two segments; a first segment in which the signal electrode voltage "VX1" equals "+VSIG" and a second segment in which the signal electrode voltage "VX1" equals "−VSIG". The voltage V (X1, Y1) is given by "+VSEL−VSIG" in the first segment (referred to as an "off period") and the voltage V (X1, Y1) is given by "+VSEL+VSIG" in the second segment (referred to as an "on period"). A signal electrode voltage during the "on period" is referred to as an "on-state voltage VON" and that during the "off period" is referred to as an "off-state voltage VOFF".

The voltage (X1, Y1) is actually the sum of the voltage applied to the liquid crystal layer 18 and the voltage applied to the nonlinear two-terminal device 20. The voltages "±VSEL" and "±VSIG" are determined such that the absolute voltage "VSEL−VSIG" is less than the threshold value "Vth" of the nonlinear two-terminal device 20 and the absolute voltage "VSEL+VSIG" is greater than the threshold value "Vth". Accordingly, the longer the "on period" is, the greater the effective voltage applied to the liquid crystal layer 18 is. In other words, the switching timing of the signal electrode voltage is adjusted such that the rate of the "on period" increases as the gradation to be given to a pixel increases (as the gradation becomes dark for a normally white mode).

The polarity is determined based on the reference voltage "VGND." The selection voltage of reverse polarity represents a negative selection voltage with respect to a positive selection voltage (or a positive selection voltage with respect to a negative selection voltage).

Figure 3:
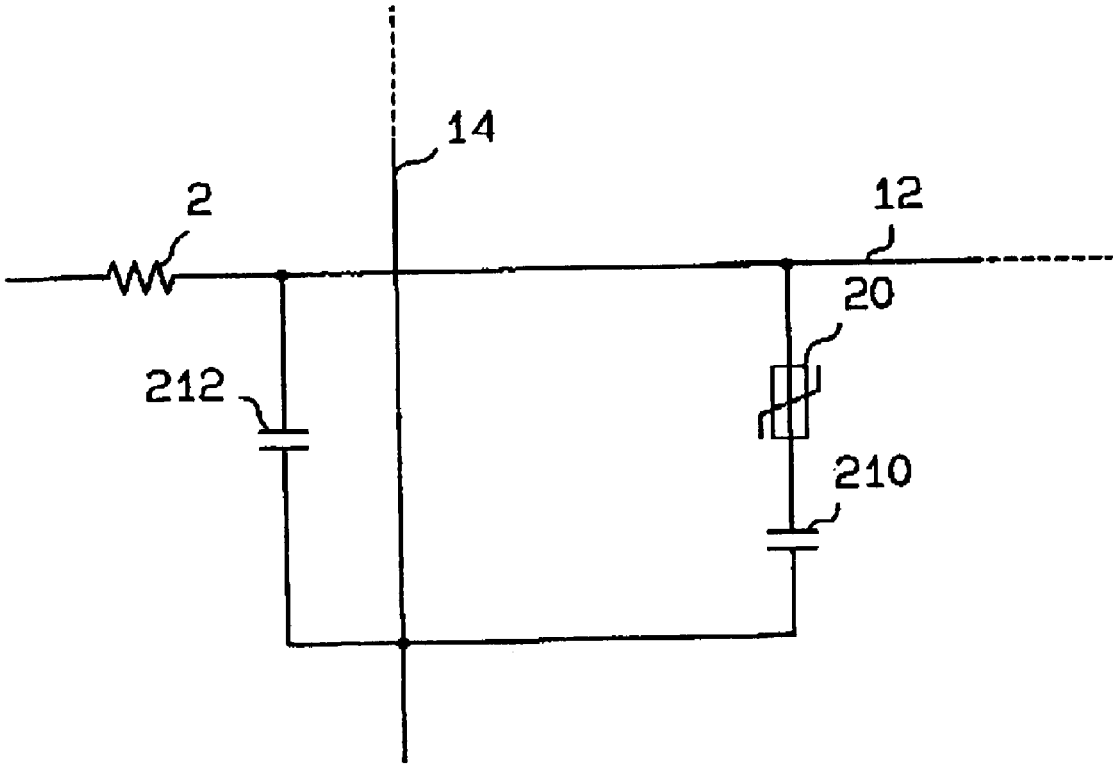
FIG. 3 is a schematic that shows an equivalent circuit of a liquid crystal display 101.

FIG. 3 shows an equivalent circuit of the liquid crystal display 101. A resistance 2 of the scanning electrode 12 is the sum of the internal resistance of each of the scanning electrodes 12, the output resistance of the scanning-signal drive circuit 80, the resistance of the lead wire between the scanning-signal drive circuit 80 and the corresponding scanning electrode 12, and so on. Reference numeral 212 denotes a capacitance between the signal electrode and the scanning electrode. Reference numeral 210 denotes a capacitance 210 in the liquid crystal layer 18. The equivalent circuit in FIG. 3 is a differential circuit for the signal electrode voltage. In other words, when the signal electrode voltage is changed in the form of rectangular waves, impulse noise is superimposed on the scanning electrode voltage at rising edges and falling edges.

Figure 5:
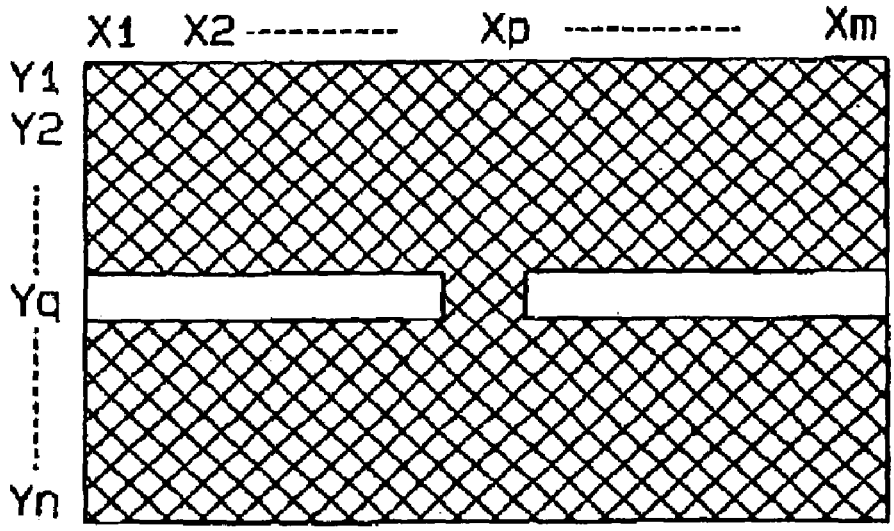
FIGS. 5(*a*) and 5(*b*) are schematics describing the crosstalk.
Figure 5:
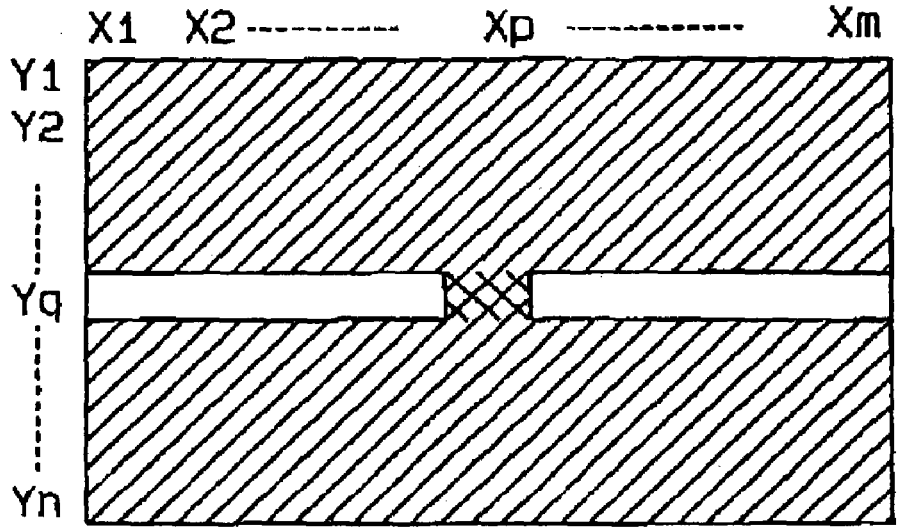

An example of an image with induced crosstalk is described below with reference to FIGS. 5(*a*) and 5(*b*). FIG. 5(*a*) shows an example of an ideal image to be displayed. Lines X1 to X(p−1) and lines X(p+1) to Xm of a row Yq are displayed in "white (0% gradation)" and the remaining portions are displayed in halftone density (50% gradation). FIG. 5(*b*) shows an example of an image with induced crosstalk. A pixel (Xp, Yq) sandwiched between two long white portions has a substantially ideal halftone density, although halftone-density parts other than the pixel (Xp, Yq) have a lower density than the ideal halftone density.

Figure 4:
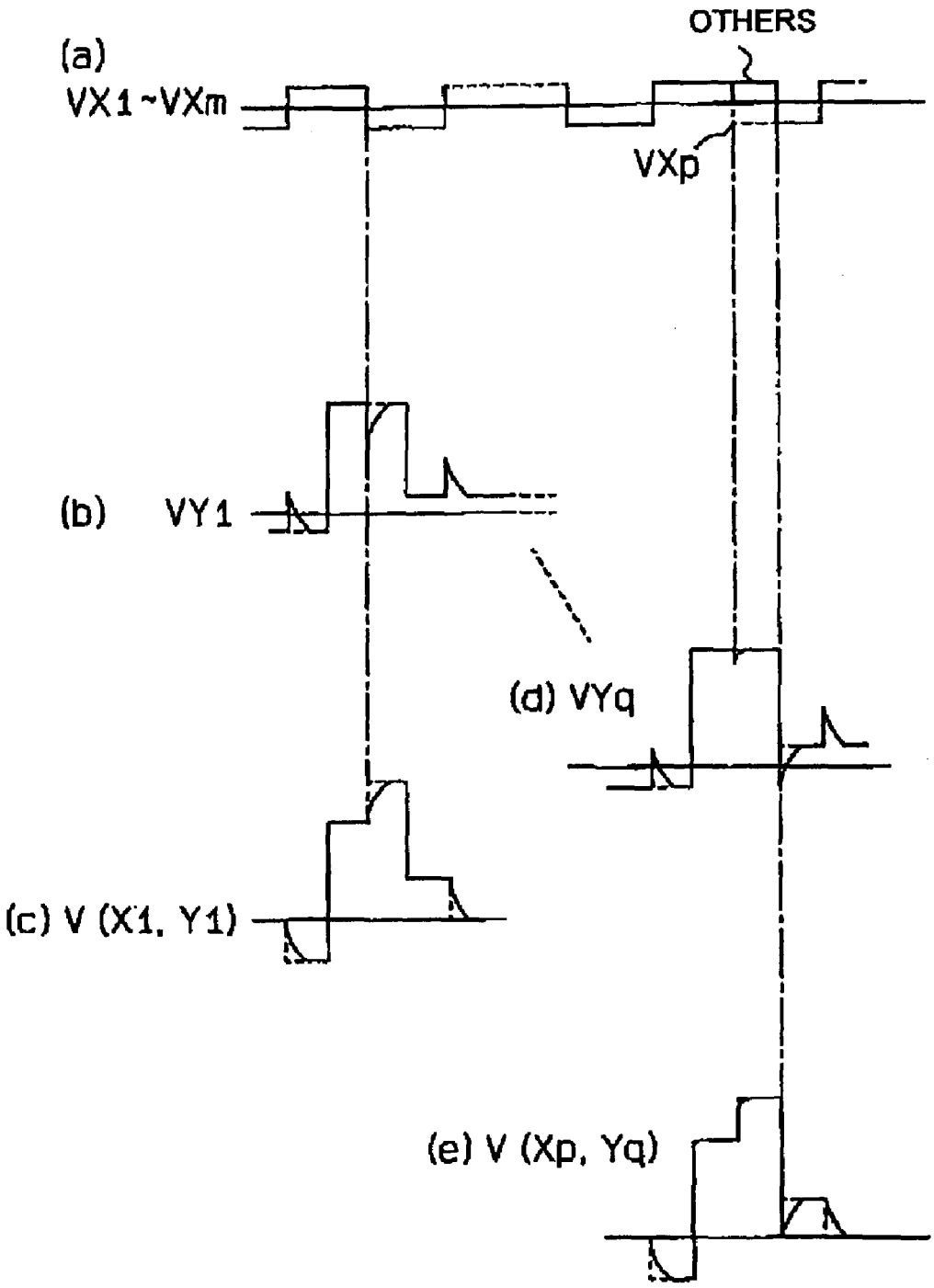
FIGS. 4(*a*)–4(*e*) are waveforms of components in FIG. 1 when crosstalk is induced.

Possible causes of such crosstalk are described with reference to FIGS. 4(*a*)–4(*e*). FIGS. 4(*a*)–4(*e*) are waveforms when it is assumed that the "selection voltage±VSEL'" and the "hold voltage±VHLD'" are respectively equal to the voltage "±VSEL" and "±VHLD." FIG. 4(*a*) shows a waveform resulting from overlapping of waveforms of the signal electrode voltages "VX1, VX2, . . . , VXm" that are respectively applied to the signal electrodes "X1, X2, . . . , Xm." FIG. 4(*b*) shows a waveform of the scanning electrode voltage "VY1" applied to the scanning electrode "Y1." Since all pixels have the same halftone density in the row "Y1" (refer to FIGS. 5(*a*) and 5(*b*)) in the image, all of the signal electrode voltages "VX1, VX2, . . . , VXm" simultaneously fall during the selection period of the scanning electrode "Y1."

Accordingly, impulse noise is applied via all of the signal electrodes to the scanning electrode Y1 at the falling edge, so that the scanning electrode voltage "VY1" largely falls around the midpoint of the selection period, as shown in FIG. 4(*b*). The voltage V (X1, Y1) is applied to the pixel (X1, Y1) as shown in FIG. 4(*c*) where the voltage V (X1, Y1) is reduced or suppressed from rising at the start of the "on period," thus causing the density of the pixel (X1, Y1) to be higher than an ideal density. The same situation arises in other halftone pixels other than the pixel (Xp, Yq).

FIG. 4(*d*) shows a waveform of a scanning electrode voltage "Vyq" applied to a scanning electrode "Yq". Since all of the pixels other than the pixel (Xp, Yq) are displayed in "white" in the row "Yq" (refer to FIGS. 5(*a*) and 5(*b*)), all of the signal electrode voltages other than a signal electrode voltage "VXp" are maintained at the off-stage voltage "VOFF" during the selection period of the scanning electrode "Yq." In contrast, since the pixel (Xp, Yq) is displayed in the halftone density, the signal electrode voltage "VXp" falls around the midpoint of the selection period of the scanning electrode "Yq."

Accordingly, at the falling edge of the signal electrode voltage "VXp", the impulse noise is applied only from the signal electrode "Xp" to the scanning electrode "Yq", so that the scanning electrode voltage "Vyq" slightly falls around the midpoint of the selection period, as shown in FIG. 4(*d*). The voltage V (Xp, Yq) is applied to the pixel (Xp, Yq) as shown in FIG. 4(*e*) where the voltage V (Xp, Yq) is slightly reduced or suppressed from rising at the start of the "on period" to cause the density of the pixel (Xp, Yq) to be a substantial ideal density. As described above, the crosstalk varies the density of pixels that should realize the same halftone density, thus decreasing the image quality.

Correction of the above crosstalk is described below. The dummy scanning electrode 50 that is formed in the same manner as the scanning electrodes 12 is provided in the first exemplary embodiment, so that noise, which is similar to the noise applied from each signal electrodes 14 to the corresponding scanning electrode 12, is to be applied to the dummy scanning electrode 50. However, since the non-inverting input and the inverting input of the operational amplifier 32 are imaginary short-circuited, the voltage of one end of the dummy scanning electrode 50 connected to the inverting input is always maintained at the reference voltage "VGND." In other words, although the voltage at the output terminal of the operational amplifier 32 varies, the voltage of the dummy scanning electrode 50 is maintained a certain level by applying the varied voltage to the resistor 34.

The resistance value of the resistor 34 is close to that of the resistance 2 of the scanning electrode 12 in FIG. 3.

The variation in output voltage of the operational amplifier 32 is superimposed on the "voltage+VSEL" at the resistor 40 and the capacitor 36, and the variation in output voltage of the operational amplifier 32 is superimposed on the "voltage−VSEL" at the resistor 42 and the capacitor 38. That is, the "selection voltages±VSEL'" are increased or decreased in order to eliminate the crosstalk.

In other words, when the varied voltage, which varies with respect to the reference voltage "VGND" output from the output terminal of the operational amplifier 32, is applied to the dummy scanning electrode 50 via the resistor 34, the voltage of the one end of the dummy scanning electrode 50 is always maintained at the reference voltage VGND. Since the same varied voltage±VSEL'" are applied to the scanning electrode 12 via the resistance 2 of the scanning electrode 12 shown in FIG. 3, the voltage of the scanning electrode 12 is also substantially maintained at a certain level to correct the crosstalk.

Figure 6:
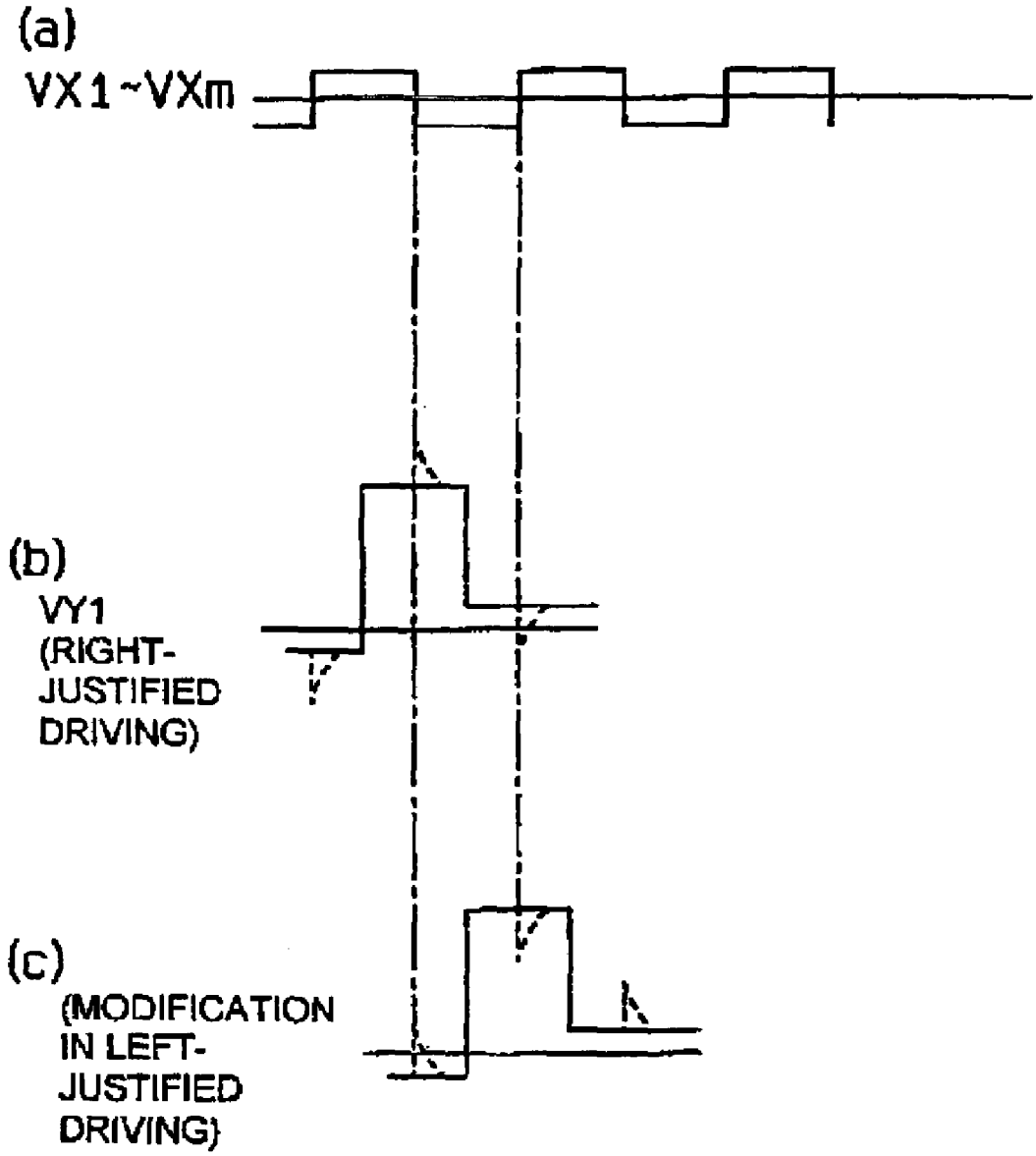
FIGS. 6(*a*)–6(*c*) are waveforms of components in the first exemplary embodiment.

FIG. 6(*a*) shows a waveform resulting from the overlapping of the waveforms of the signal electrode voltages "VX1, VX2, . . . , VXm." FIG. 6(*b*) shows a waveform of the corrected scanning electrode voltage "VY1." A broken line in FIG. 6(*b*) shows the waveform of the voltage "VSEL'" and a solid line in FIG. 6(*b*) shows the waveform of the scanning electrode voltage "VY1." The voltage "VSEL'" simultaneously rises with the falling of the signal electrode voltages "VX1, VX2, . . . , VXm" to offset the downward crosstalk, so that the scanning electrode voltage "VY1" exhibits the waveform shown by the solid line.

At the scanning electrode voltage "VY1," the impulse noise as shown in FIG. 4(*b*) is eliminated. The crosstalk induced by the signal electrodes is also corrected at the other scanning electrode voltages. Accordingly, all of the scanning electrode voltages have almost the same waveform and the voltages having almost the same waveform are applied to the pixels that should give the same gradation, thus eliminating the non-uniformity of display caused by the crosstalk.

Figure 1:
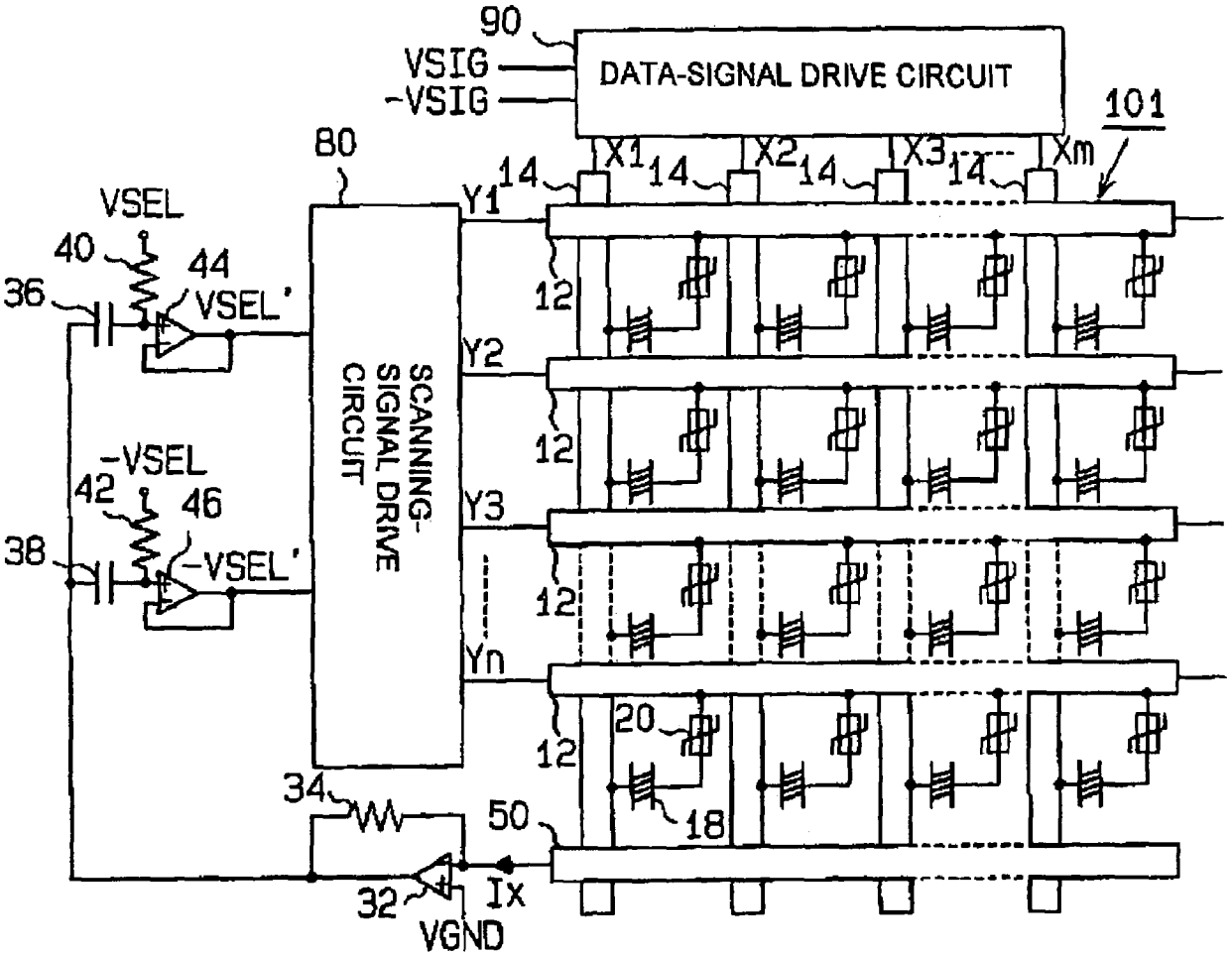
FIG. 1 is a schematic of an electro-optical device according to a first exemplary embodiment of the present invention.
Figure 8:
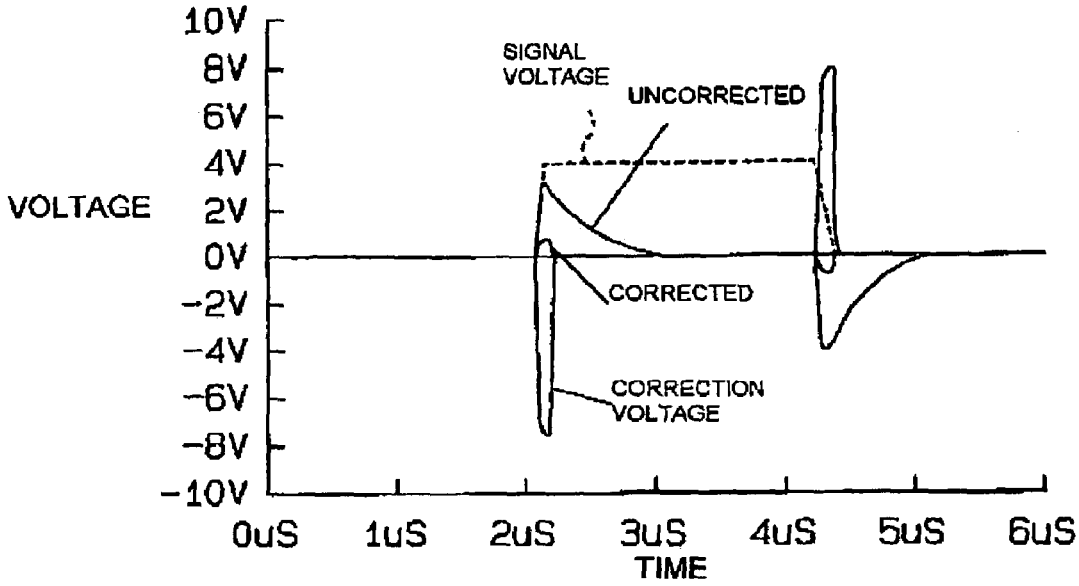
FIGS. 8(*a*) and 8(*b*) are graphs showing the measured crosstalk according to the first and second exemplary embodiments.
Figure 8:
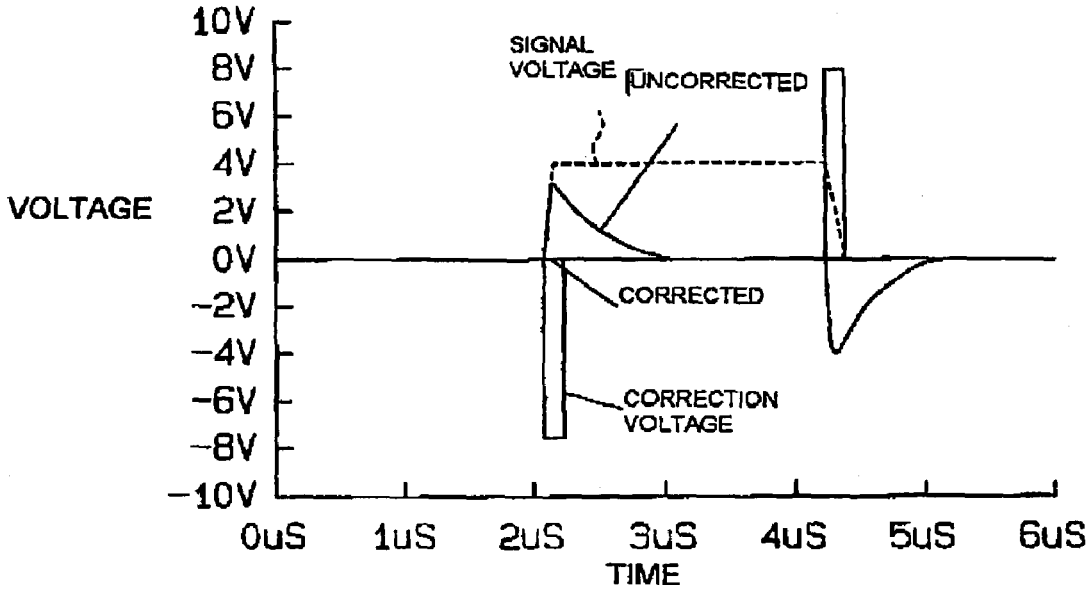

FIG. 8(*a*) shows the voltage waveform at one scanning electrode when the signal voltage in the form of rectangular waves is simultaneously applied to each signal electrodes in FIG. 1. The signal voltage is shown by a broken line. A "correction voltage" in FIG. 8(*a*) shows a terminal voltage at the resistor 34. An "uncorrected" waveform is a voltage waveform at the scanning electrode when the operational amplifier 32 and the resistor 34 are removed. A "corrected" waveform is a voltage waveform at the scanning electrode when the operational amplifier 32 and the resistor 34 are provided as shown in FIG. 1.

Figure 7:
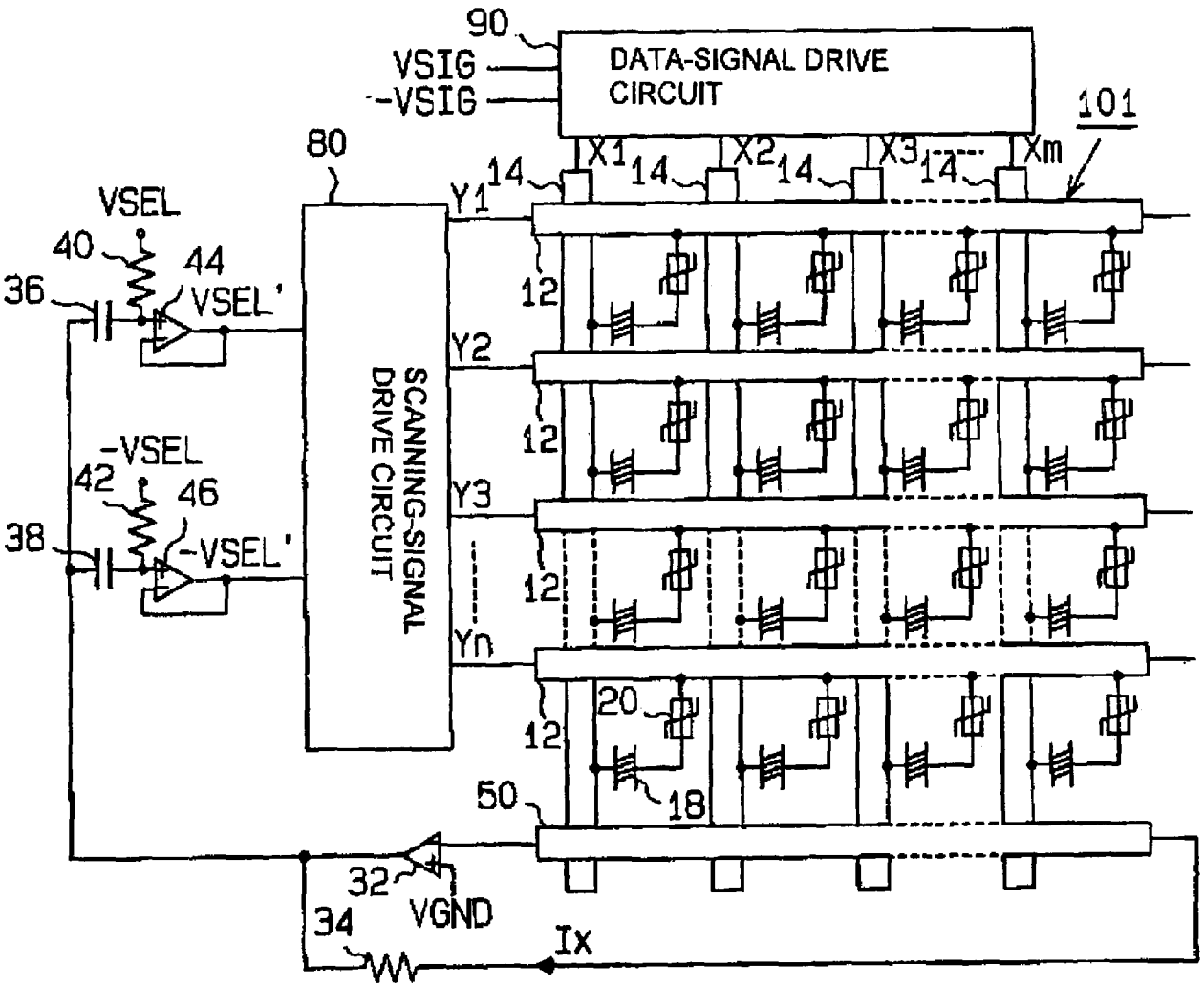
FIG. 7 is a schematic of an electro-optical device according to a second exemplary embodiment of the present invention.

The structure of a liquid crystal display according to a second exemplary embodiment of the present invention is described below with reference to FIG. 7. The same reference numerals are used to identify the same elements shown in FIG. 1. Referring to FIG. 7, the inverting input terminal of the operational amplifier 32 is connected to one end of the dummy scanning electrode 50 and the other end of the dummy scanning electrode 50 is connected to the output terminal of the operational amplifier 32 via the resistor 34. Except for these connections, the liquid crystal display of this embodiment has the same structure as the liquid crystal display of the first embodiment (FIG. 1).

In the liquid crystal display of this exemplary embodiment, the current "Ix" flows such that the voltages not only at the one end of the dummy scanning electrode 50 but also at the overall dummy scanning electrode 50 are maintained at the reference voltage "VGND." FIG. 8(*b*) shows the voltage waveform at one scanning electrode when the signal voltage in the form of rectangular waves is simultaneously applied to the signal electrodes in the structure in FIG. 7. Comparison of FIG. 8(*a*) with FIG. 8(*b*) shows that, in the second exemplary embodiment, the adverse effect of the crosstalk can be almost eliminated and a more precise correction than in the first exemplary embodiment can be achieved.

Figure 10:
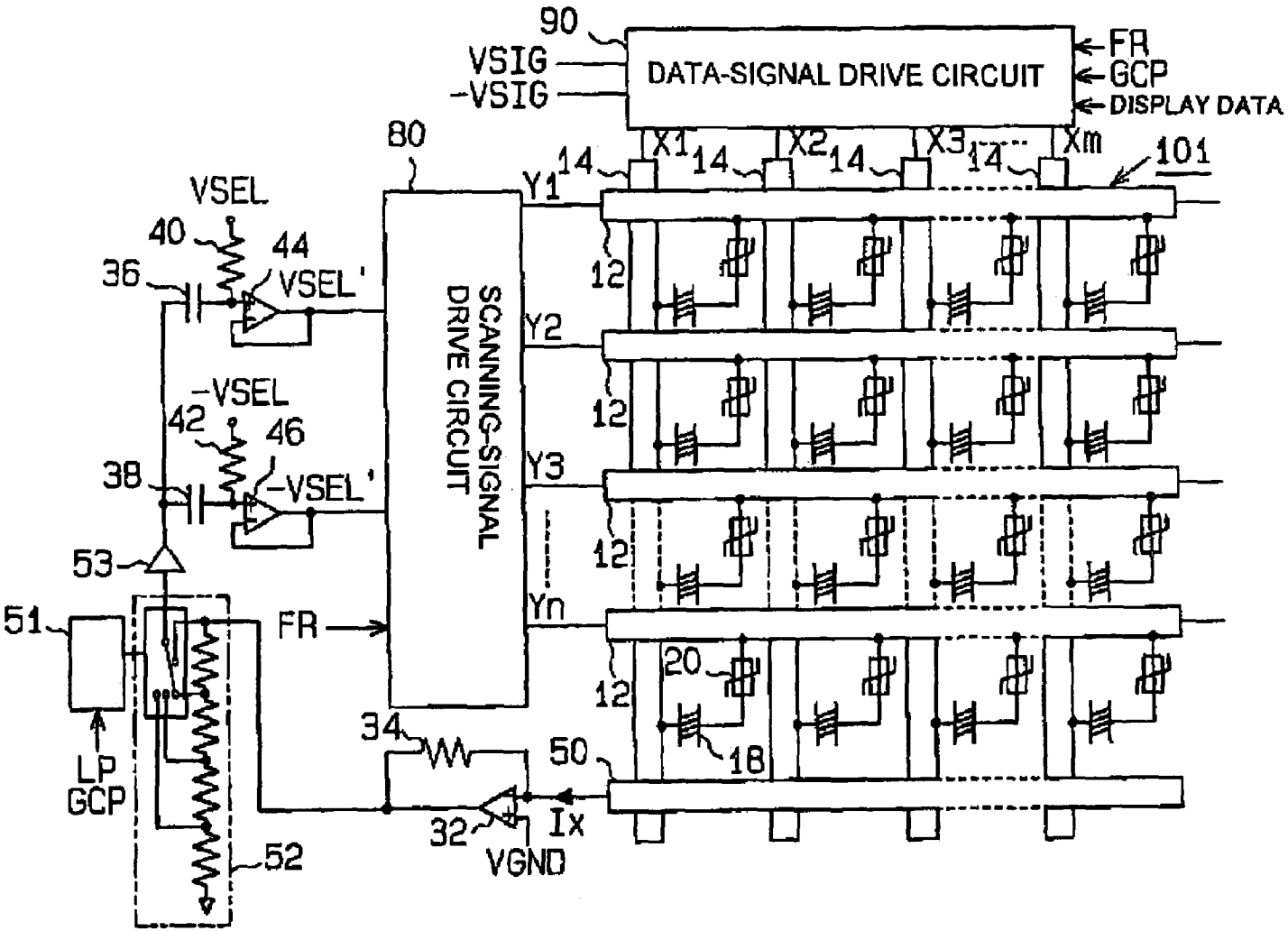
FIG. 10 is a schematic of an electro-optical device according to a third exemplary embodiment of the present invention.

The structure of a liquid crystal display according to a third exemplary embodiment of the present invention is described below with reference to FIGS. 10 to 12. The liquid crystal display of the third exemplary embodiment differs from those of the first and second exemplary embodiments in that the "voltages±VSEL'" are increased or decreased depending on the gradation of each of the pixels. The same reference numerals are used to identify the same elements of the first and second exemplary embodiments.

Figure 11:
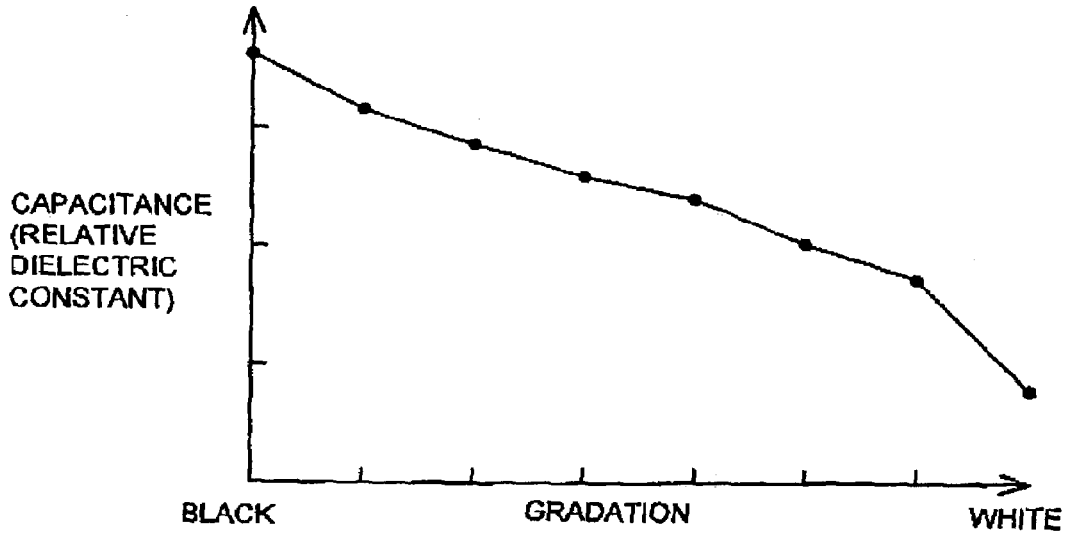
FIG. 11 is a graph showing the relationship between a gradation and a liquid crystal capacitance (relative dielectric constant)

FIG. 11 is a graph showing the relationship between the gradation and the capacitance (relative dielectric constant) of the liquid crystal layer 18. The reasons why the "voltages±VSEL'" are increased or decreased depending on the gradation of each of the pixels will now be described with reference to FIG. 11. As shown in the FIG. 11, since the capacitance (relative dielectric constant) of the liquid crystal layer 18 varies with the gradation, the capacitance of the pixel on each scanning electrode "Yi" varies with the gradation. With the same number of signal electrodes "Xj," the impulse noise superimposed on the scanning electrode voltage by the signal electrode voltage corresponding to black is approximately two times as large as the impulse noise superimposed on the scanning electrode voltage by the signal electrode voltage corresponding to white. Accordingly, the impulse noise superimposed on the actual scanning electrode voltage in response to the variation of the signal electrode voltage corresponding to an "off pixel" having white gradation differs in level from the impulse noise superimposed on the actual scanning electrode voltage in response to the variation of the signal electrode voltage corresponding to an "on pixel" having black gradation. For example, the latter impulse noise is larger than the former one.

In contrast, the capacitance between the dummy scanning electrode 50 and the signal electrode "Xj," the capacitance being unrelated to the gradation, is maintained at a certain level. When the same number of the signal electrodes "Xj" are used, the "voltages±VSEL'" are increased or decreased by the same level unrelated to the gradation in the exemplary embodiments described above.

When the "voltage±VSEL'" is increased or decreased by directly using the output voltage of the operational amplifier 32 in order to maintain the voltage at one end of the dummy scanning electrode 50 at the reference voltage "VGND," for example, the "off pixels" are excessively corrected and the "on pixels" are insufficiently corrected, thus the crosstalk cannot be corrected. From this point of view, in the third exemplary embodiment, the crosstalk is corrected with the consideration of the difference in gradation.

Figure 12:
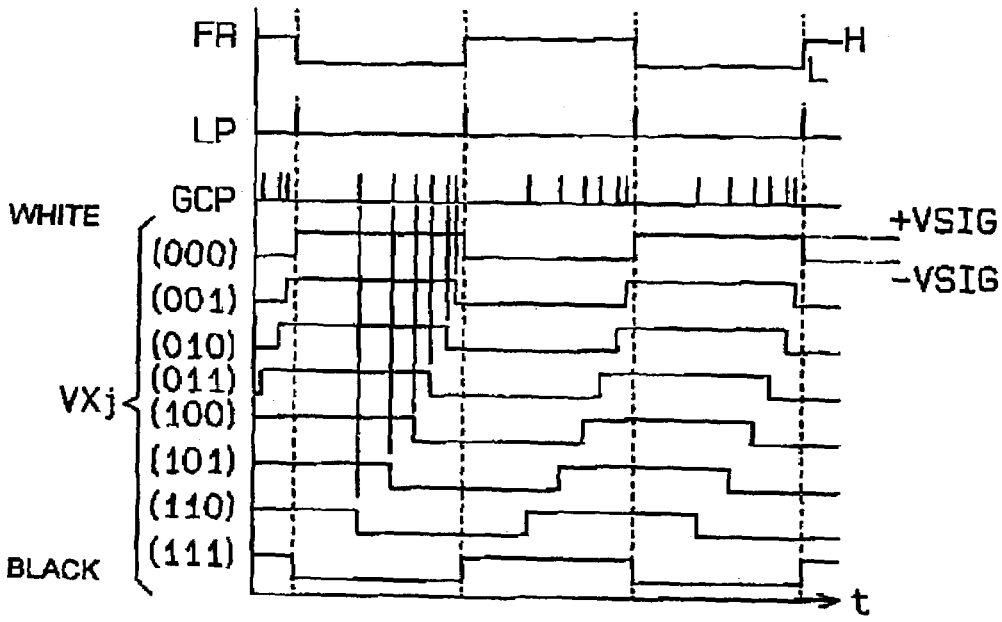
FIG. 12 is a time chart showing exemplary waveforms of scanning electrode voltages and control signals.

FIG. 12 is a time chart showing exemplary waveforms of a polarity indicating signal "FR", a scanning-period determining signal "LP", a gradation determining signal "GCP" to specify a gradation, which are output from a control circuit (not shown), and signal electrode voltages "VXj" corresponding to each gradation (gradation determining signals "GCP"). The basic operation of the liquid crystal display is described below. The scanning-period determining signal "LP" determines the line selection period (horizontal scanning period) having a predetermined time width. The polarity indicating signal "FR" is reversed in synchronous with the scanning-period determining signal "LP." The polarity indicating signal "FR," which determines a writing polarity of the signal electrode voltage, is input to the scanning-signal drive circuit 80, the data-signal drive circuit 90, and so on via the control unit (refer to FIG. 10).

When the polarity indicating signal "FR" of an "L level" is input, the scanning-signal drive circuit 80 applies a scanning electrode voltage "Vyi" having a level of "voltage+VSEL'" to the scanning electrode "Yi" that is selected. When the polarity indicating signal "FR" of an "H level" is input, the scanning-signal drive circuit 80 applies a scanning electrode voltage "Vyi" having a level of "voltage−VSEL'" to the scanning electrode "Yi" that is selected (refer to FIG. 2).

Display data from the control circuit and the gradation determining signal "GCP," as well as the polarity indicating signal FR, are input to the data-signal control unit 90. The display data, which is, for example, three-bit data (spq) (s, p, and q each have a value of 0 or 1), is input for every signal electrode "Xj" (pixel) connected to the selected scanning electrode "Yi". When the electro-optical device is driven in a normally white mode, a white image is displayed for the display data (000) and a black image is displayed for the display data (111). The gradation varies stepwise to reduce the brightness of the image from (000) to (111). As shown in FIG. 12, the gradation determining signal "GCP" rises to divide one line selection period "T" into seven segments. When the polarity indicating signal "FR" of the "L level" is input, the data-signal drive circuit 90 applies the signal electrode voltage "VXj" having a level of "+VSIG" to the signal electrode "Xj", excluding a case where the signal electrode voltage corresponds to the display data (111). The data-signal drive circuit 90 sequentially changes the signal electrode voltage "VXj" corresponding to the display data (110), the signal electrode voltage "VXj" corresponding to the display data (101), . . . , and the signal electrode voltage "VXj" corresponding to the display data (001) to "−VSIG," each time the gradation determining signal "GCP" rises. When the polarity indicating signal "FR" of the "L level" is input, the data-signal drive circuit 90 applies the signal electrode voltage "VXj" having a level of "−VSIG" to the signal electrode "Xj" during the selection period, in a case that the signal electrode voltage corresponds to the display data (111). In a case that the signal electrode voltage corresponds to the display data (000), the signal electrode voltage "VXj" is to be changed to "−VSIG" in response to the next gradation determining signal "GCP". However, since the scanning-period determining signal "LP" is input to select the next scanning electrode "Yi+1" before the signal electrode voltage "VXj" is changed to "−VSIG", the selection period of the scanning electrode "Yi" terminates while maintaining the signal electrode voltage "VXj" at "+VSIG". Although the case in which the polarity indicating signal "FR" of the "L level" is input has been described, the operation of the liquid crystal display proceeds in the opposite direction when the polarity indicating signal "FR" of the "H level" is input. Specifically, the data-signal drive circuit 90 sequentially changes the signal electrode voltages VXj in the reverse order of the case described above, that is, the order from (000) to (111) in FIG. 12 is replaced with the order from (111) to (000).

The data-signal drive circuit 90 applies the signal electrode voltage "VXj", which changes its polarity in accordance with the display data (spq) and the gradation determining signal "GCP", to the signal electrode "Xj."

In the operation described above, the length of the "on period" that determines the gradation of each pixel is controlled by the gradation determining signal "GCP". The capacitance of each pixel that becomes dark in proportion to the length of the "on period" becomes large in proportion to the length of the "on period." In other words, the operation described above determines the noise produced by each of the signal electrode in response to the timing (i.e., the gradation determining signal GCP) of switching between the "off period" and the "on period."

Next, the structure of the liquid crystal display that increases or decreases the "voltage±VSEL'" in accordance with the gradation of each pixel based on the relationship between the gradation determining signal "GCP" and the noise is described with reference to FIG. 10.

In this exemplary embodiment, a counter circuit 51, a decoder 52 serving as a weighting circuit, and a buffer circuit 53 are arranged between the output terminal of the operational amplifier 32 and the capacitors 36 and 38.

The scanning-period determining signal "LP" and the gradation determining signal "GCP" are input to the counter circuit 51. The counter circuit 51 counts the times of rising of the gradation determining signal "GCP" and resets the counter value in synchronous with the scanning-period determining signal "LP." Specifically, the counter circuit 51 counts the times of rising of the gradation determining signal GCP from zero to six during each of the selection periods. The counter value from the counter circuit 51 determines the noise produced by each signal electrodes at the corresponding timing. The counter circuit 51 outputs the counter value to the decoder 52.

The output terminals of the counter circuit 51 and the operational amplifier 32 are connected to the decoder 52, and the capacitors 36 and 38 are connected to the decoder 52 via the buffer circuit 53. The counter value of the counter circuit 51 and the output voltage of the operational amplifier 32 are input to the decoder 52. The decoder 52 selectively outputs a voltage, which is given by resistance division of the output voltage of the operational amplifier 32 in accordance with the counter value, to the capacitors 36 and 38 via the buffer circuit 53. The output voltage of the operational amplifier 32 is preferably controlled by the resistance division using the decoder 52 in accordance with the timing of switching between the "on period" and the "off period" and the noise characteristic. The decoder 52 incorporates seven switching terminals (for simplicity, only four terminals are shown in FIG. 10) to control the output voltage of the operational amplifier 32 for the resistance division in accordance with the counter value in this embodiment. The decoder 52 switches the switching terminals for the resistance division so as to directly output the output voltage of the operational amplifier 32 via the buffer circuit 53 when, for example, the counter value is reset to zero.

Moreover, the decoder 52 gradually switches the switching terminals for the resistance division such that the greater the counter value is, the lower the voltage output via the buffer circuit 53 is. Namely, the decoder 52 switches the switching terminals for the resistance division, such that the voltage output via the buffer circuit 53 increases as the counter value decreases and the rate of the "on period" increases (as the gradation comes close to black), and such that the voltage output via the buffer circuit 53 decreases as the counter value increases and the rate of the "on period" decreases (as the gradation comes close to white).

The "voltages±VSEL'" that are increased or decreased in accordance with the gradation of each pixel are applied to the scanning electrodes 12 in the manner described above, and therefore the crosstalk can be preferably corrected even if the gradations are different.

4. EXEMPLARY MODIFICATIONS

The present invention is not limited to the exemplary embodiments described above and may be subjected to the following exemplary modifications.

(1) In the above exemplary embodiments, the "off period" is provided before the "on period" in each selection periods (refer to FIG. 2(*e*)). Such a method in which the "off period" precedes the "on period" is referred to as a "right-justified driving". In contrast, a method in which the "on period" precedes the "off period" is referred to as a "left-justified driving". The exemplary embodiments described above may be implemented by using the left-justified driving.

FIG. 6(*c*) shows an exemplary waveform of the scanning electrode voltage "VY1" in the left-justified driving. The waveform that actually appears at the scanning electrode in the left-justified driving is the same as in the right-justified driving and the "selection voltages±VSEL'" and so on of the level shown by a broken line are actually applied to the scanning-signal drive circuit 80. Hence, in the right-justified driving, the breakdown voltage of the scanning-signal drive circuit 80 must be greater than the absolute value of "±VSEL". In contrast, in the left-justified driving, "±VSEL" is enough for the breakdown voltage of the scanning-signal drive circuit 80, thus advantageously reducing the breakdown voltage of the scanning-signal drive circuit 80.

Although the drive circuit for an electro-optical device of the present invention is applied to a TFD liquid crystal display in the exemplary embodiments described above, the drive circuit of the present invention is not limited to the TFD liquid crystal display and may be applied to various electro-optical apparatuses, each having an electro-optical device that includes a plurality of signal electrodes and a plurality of scanning electrodes intersecting with the signal electrodes and having the possibility of being subjected to crosstalk between the signal electrodes and the scanning electrodes.

Although the current "Ix" is supplied via the dummy scanning electrode 50 that is not used to display an image in the exemplary embodiments described above, the operational amplifier 32 and the resistor 34 may be connected to any scanning electrode that is not selected among the scanning electrodes 12, 12 . . . instead of the dummy scanning electrode. In such a case, the current "Ix" flowing through the scanning electrode may correct the crosstalk appearing at other scanning electrodes. For example, the scanning electrode "Y1 " at the top of the display and the scanning electrode "Yn" at the bottom of the display may be alternately used for every half frame instead of the dummy scanning electrode 50.

In the exemplary embodiments described above, the polarities of the voltage waveforms of the signal electrode voltages "VXj" corresponding to white and black are reversed in synchronous with the scanning-period determining signal "LP" to offset the distortion of the voltage waveforms. In this case, the distortion occurs in the same manner in both a case where many signal electrodes corresponding to white and many signal electrodes corresponding to black exist and a case where no signal electrode corresponding to white and a few signal electrodes corresponding to black exist. Hence, it is difficult to correct the selection voltage. To address or resolve such a problem, actual application of the selection voltage may be delayed with respect to the scanning-period determining signal "LP." This reduces or prevents the effect of the distortion caused by the signal electrode voltages "VXj" corresponding to white and black.

The electro-optical apparatus according to the exemplary embodiments described above may be applied to various electronic appliances such as a mobile computer, a cell phone, a digital still camera, a projection display unit, a liquid crystal television, a personal digital assistant, a word processor, a video tape recorder with a viewfinder or a monitor, a workstation, a video phone, a POS (point-of-sale) terminal, and a touch panel. These electronic appliances can realize image display with reducing or suppressing crosstalk.

In the third exemplary embodiment, the output voltage of the operational amplifier 32 is subjected to the resistance division using the resistance in the decoder 52. Instead of this method, the resistance of the resistor 34 may be changed in accordance with the counter value of the counter circuit 51 (gradation determining signal GCP).

In the third exemplary embodiment, although the weighting number depending on the gradation (the number of switching terminals used for the resistance division) is seven, it may be any other appropriate number.

In the third exemplary embodiment, the other end of the dummy scanning electrode 50 may be connected to the output terminal of the operational amplifier 32 via the resistor 34, as in the second exemplary embodiment.

As described above, according to the present invention, signals levels at other scanning electrodes are determined based on a signal level at one unselected scanning electrode. Hence, the crosstalk occurring at the other scanning electrodes can be corrected based on the crosstalk occurring at the unselected scanning electrode to realize high-quality images.

The invention claimed is:

1. A drive circuit to drive an electro-optical device that includes a plurality of signal electrodes and a plurality of scanning electrodes intersecting the signal electrodes, the drive circuit comprising:

a dummy scanning electrode provided next to at least one of the scanning electrodes;

an operational amplifier, wherein an inverting input terminal is connected to one end of the dummy scanning electrode, a non-inverting input terminal is connected to a reference voltage, and a resistor is connected between the inverting input terminal and an output terminal;

a counter circuit that receives a scanning-period determining signal and a gradation determining signal, wherein the counter circuit determines times of switching between an off period and an on period and counts times of rising of the gradation determining signal and resets a counter value in synchronization with the scanning period determining signal; and a decoder connected to at least one output terminal of the counter circuit and the operational amplifier, and selectively outputs a voltage which is given by resistance division of the output voltage of the operational amplifier in accordance with the counter value, wherein the decoder gradually switches a switching terminal for the resistance division such that the greater the counter value is, the lower the voltage output is, and superimposes voltage output on a selection voltage which is applied to the scanning electrodes.

2. An electro-optical apparatus, comprising:

the drive circuit for the electro-optical device according to claim 1.

3. An electronic appliance, comprising:

the drive circuit for the electro-optical device according to claim 1.

4. The drive circuit for the electro-optical device according to claim 1, wherein a variation in output voltage of the decoder is superimposed on the selection voltage at a resistor and a capacitor.

* * * * *